US005315358A

United States Patent [19]

Parks et al.

[11] Patent Number: 5,315,358

[45] Date of Patent: May 24, 1994

[54] FLICKER BAR WITH AN INTEGRAL AIR CHANNEL

[75] Inventors: Bruce J. Parks, West Bloomfield; John S. Vouros, Farmington, both of N.Y.

[73] Assignee: Xerox Corporation, Stamford, Conn.

[21] Appl. No.: 47,513

[22] Filed: Apr. 19, 1993

[51] Int. Cl.[5] ..... G03G 21/00

[52] U.S. Cl. ..... 355/302; 15/256.5; 355/298

[58] Field of Search ..... 355/296, 298, 301, 302; 118/652; 15/256.5, 256.51, 256.52

[56] References Cited

U.S. PATENT DOCUMENTS

| | | | |
|---|---|---|---|
| 3,534,427 | 10/1970 | Severynse | 355/302 X |
| 3,590,412 | 7/1971 | Gerbasi | 355/302 X |
| 3,706,108 | 12/1972 | Taylor | 15/1.5 |
| 3,969,785 | 7/1976 | Ogawa et al. | 355/302 X |
| 4,123,154 | 10/1978 | Fisher | 355/303 |
| 4,304,026 | 12/1981 | Borostyan | 355/301 X |
| 4,435,073 | 3/1984 | Miller | 355/305 |
| 4,851,880 | 7/1989 | Ziegelmuller et al. | 355/302 |
| 5,128,725 | 7/1992 | Frankel et al. | 355/301 |

OTHER PUBLICATIONS

Sanders, "Air Wedge and Air Entry," IBM Technical Disclosure Bulletin, vol. 19, No. 8, Jan. 1977, pp. 3215.

*Primary Examiner*—A. T. Grimley
*Assistant Examiner*—William J. Royer
*Attorney, Agent, or Firm*—T. L. Fair

[57] ABSTRACT

A cleaning apparatus having a flicker bar for detoning particles from the cleaning brushes. The flicker bar has an air channel integral therein. The solitary construction and the support bars in the top member of the flicker bar provides a uniform air channel width that is not compromised due to assembly tolerances.

8 Claims, 4 Drawing Sheets

FLICKER BAR WITH AN INTEGRAL AIR CHANNEL

BACKGROUND OF THE INVENTION

This invention relates generally to an electrostatographic printer or copier, and more particularly concerns a cleaning apparatus used therein.

In an electrophotographic application such as xerography, a charge retentive surface (i.e. photoconductor, photoreceptor or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being produced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface may be imagewise discharged in a variety of ways. Ion projection devices where a charge is imagewise deposited on a charge retentive substrate operate similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a rotatable brush that frictionally engages the imaging surface to remove the residual toner and paper particles therefrom.

In brush cleaners such as those in a xerographic cleaner where a rotating brush is used to clean (via mechanical, electrostatic, or other means) toner (or other particles such as carrier beads, paper fibers, etc.) from the photoreceptor (or any other surface for that matter), detoning (or cleaning) the brush is necessary. Air detoning is one method where an air stream is pulled through the brush fibers, carrying away toner (and other collected debris). To enhance the lessening of debris from the brush fibers in this type of system, flicking devices (one or more) are employed to disturb the fibers and a nearby air slot provides the air flow to pull away loosened debris. The mechanical flicking is accomplished by placing some type of "flicker", e.g. a round bar, in the path of the rotating fibers. The location of "flicker bar" relative to an air slot, i.e. upstream and/or downstream may have different effects on the overall detoning performance, but will depend on the specific application. Typically, the flicker bar is considered a high wear item and requires replacement at specified intervals.

Various problems exist with the present cleaner brush detoning systems. In some systems, a flicker bar may be positioned on one side of an air passage with the other side formed by a separate part, leading to assembly-to-assembly variations in the air passage size and negatively affecting air flow characteristics that can result in clogging of the air passage. When the air passage is clogged, additional servicing (beyond servicing of the flicker bar) is required to clear the air passage. Normally, the flicker bar can only be accessed after some degree of disassembly which results in high service costs.

The following disclosures may be relevant to various aspects of the present invention and may be briefly summarized as follows:

U.S. Pat. No. 3,706,108 to Taylor discloses removing residual toner particles from a photoconductive surface using a rotating brush that contacts the surface. Removal of the residual toner particles from the brush fibers is assisted by applying a bias voltage to the brush to attract the toner particles to the brush and by using a flicker bar to loosen the toner particles from the cleaning blades.

U.S. Pat. No. 4,123,154 to Fisher discloses a cleaning apparatus wherein a flicker element removes residual material from a cleaner element. The flicker element works together with a corona charging device to neutralize the charge on the toner to aid in removal of the toner from the cleaning element.

U.S. Pat. No. 4,435,073 to Miller shows a cleaning brush with a plurality of flicker bars, at least one of which is fabricated from a material that will cause the charge on the brush to reverse at least once for every revolution of the brush, such reversal taking place while the brush fibers are subject to a toner removing airflow.

SUMMARY OF INVENTION

Briefly stated, and in accordance with one aspect of the present invention, there is provided an apparatus for removing particles from a surface. This apparatus comprises a housing and a rotatably mounted brush, at least partially enclosed in the housing, that contacts the surface to remove particles therefrom. And, a bar in contact with the brush for removing particles therefrom. The bar defines a channel therein that is adapted to have air with particles flow therethrough.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 5:
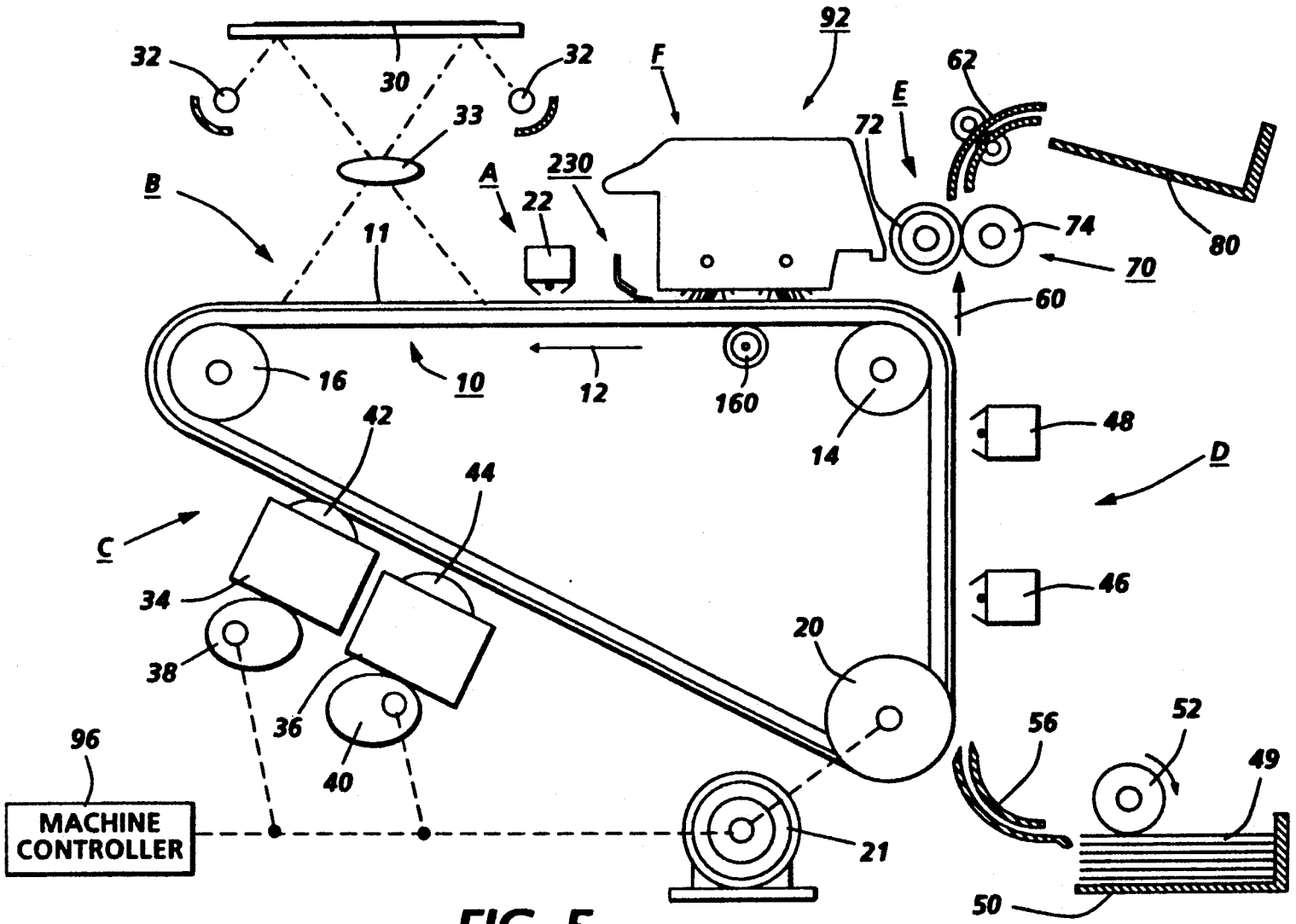
FIG. 5 is a schematic elevational view of a printing apparatus incorporating the FIG. 1 cleaning system therein.

For a general understanding of an electrophotographic printer or copier in which the present invention may be incorporated, reference is made to FIG. 5 which depicts schematically the various components thereof. Hereinafter, like reference numerals will be employed throughout to designate identical elements. Although the flicker bar of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 5 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 5, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92. Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 through 4 where the showings are for the purpose of illustrating a preferred embodiment of the invention and not for limiting the same cleaning apparatus incorporating the elements. The flicker bar is inserted above the rotating brush in a channel in the brush housing.

Figure 1:
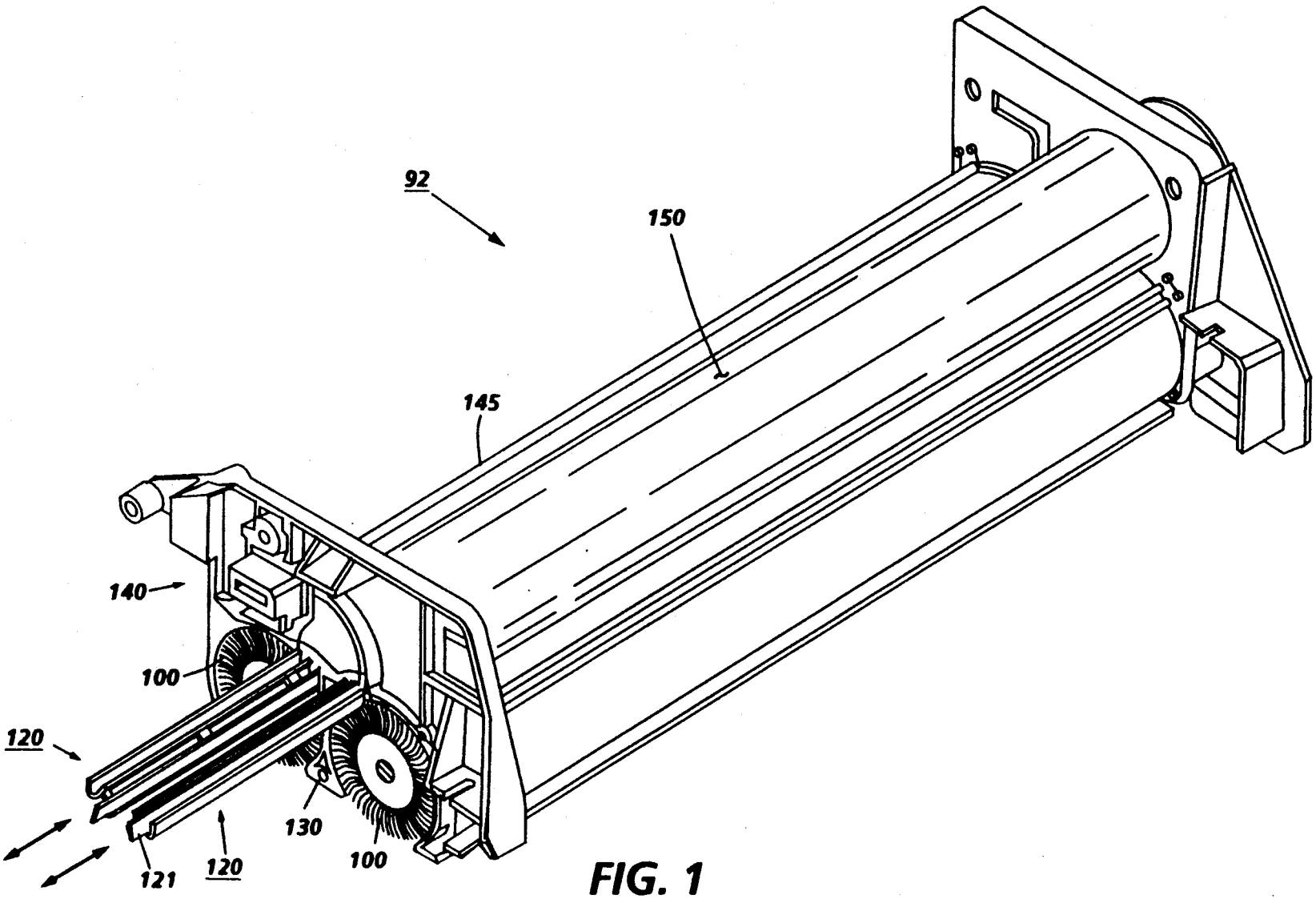
FIG. 1 is a perspective view of a cleaning system having slidably insertable flicker bars partially extending from the housing.

Reference is now made to FIG. 1, which shows a perspective view of the cleaning apparatus containing the present invention of a single construction slidable flicker bar therein. FIG. 1 shows a dual cleaning brush cleaning system. The two rotatable brushes 100 are separated from each other by a separator 130 to keep the fibers from one of the brushes from contacting the fibers of the adjacent brush. A flicker bar 120 is slidably inserted into a channel, in the cleaning housing 145, above each rotatable cleaner brush 100. The flicker bar 120 extends the length of the rotatable brush 100 in the cleaning apparatus 92. There is an end plate 140 located at the end of the cleaning apparatus. The flicker bar 120 is removed from the channel in the cleaner housing 145 by an extended piece of the flicker bar that protrudes therefrom called a handle 121. The handle 121 is located on the front end of the flicker bar 120. This handle 121 provides an accessible means to remove and insert the flicker bar 120 into and out of the housing without high service cost disassembly.

Figure 2:
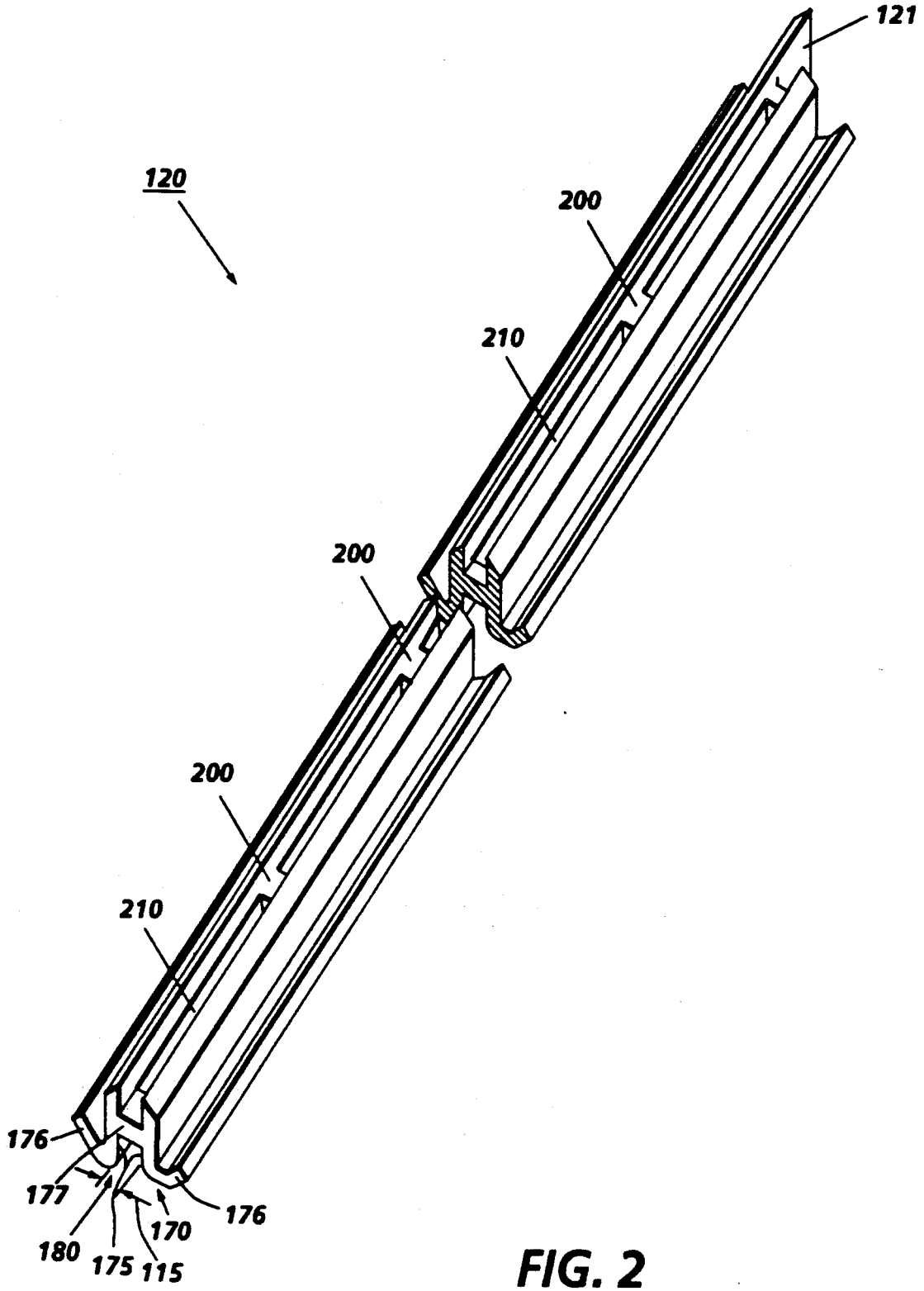
FIG. 2 is a perspective view of the slidably insertable flicker bar shown in the FIG. 1 cleaning system.

Reference is now made to FIG. 2, which shows the slidably insertable flicker bar 120 of the present invention in a view opposite the view shown in FIG. 1. The flicker bar 120 is single piece construction that contains an air channel 115 therein. The solitary construction of the flicker bar 120 provides a properly sized air channel and prevents a variable size air channel due to assembly tolerances that occur when more then one component is assembled to create an air channel. On either side of the air channel 115 are the channel walls 175, parallel to one another. The channel walls 175 flip outward forming wings 176 on either side that fit into the channel of the cleaner housing. The winged formations shown in FIG. 2, form a flat flicker bar edge 170 facing toward the brush fibers on one side of the air channel 115 and a protruding flicker bar edge 180 on the opposite side of the air channel 115. The flat flicker bar edge 170 does not contact the brush fibers. The protruding flicker bar 180 extends into contact with the rotating brush to disturb the brush fibers. Other flicker bar variations of the present invention which are not shown include: having the air channel 115 followed by a single flicker (i.e. the protruding flicker bar end 180) rather than preceding the air slot as shown in FIG. 2; having a protruding flicker bar edge 180 followed by the air channel 115 followed by another protruding flicker 180; and having no protruding flicker, but just an air channel.

With continued reference to FIG. 2, the top member 177 of the air channel 115 is perpendicular to the channel walls 175. The top member 177 contains support bars or spacers 200 that are intermittently placed along the length of the flicker bar air channel 115. These spacers 200 provide support needed to maintain the uniform width size of the air channel. Between the spacers 200 are air cavities or air slots 210 for the air entrained with toner (from the brush detoning) to flow from the air channel 115 into the air manifold 150 (shown in FIG. 3).

Figure 3:
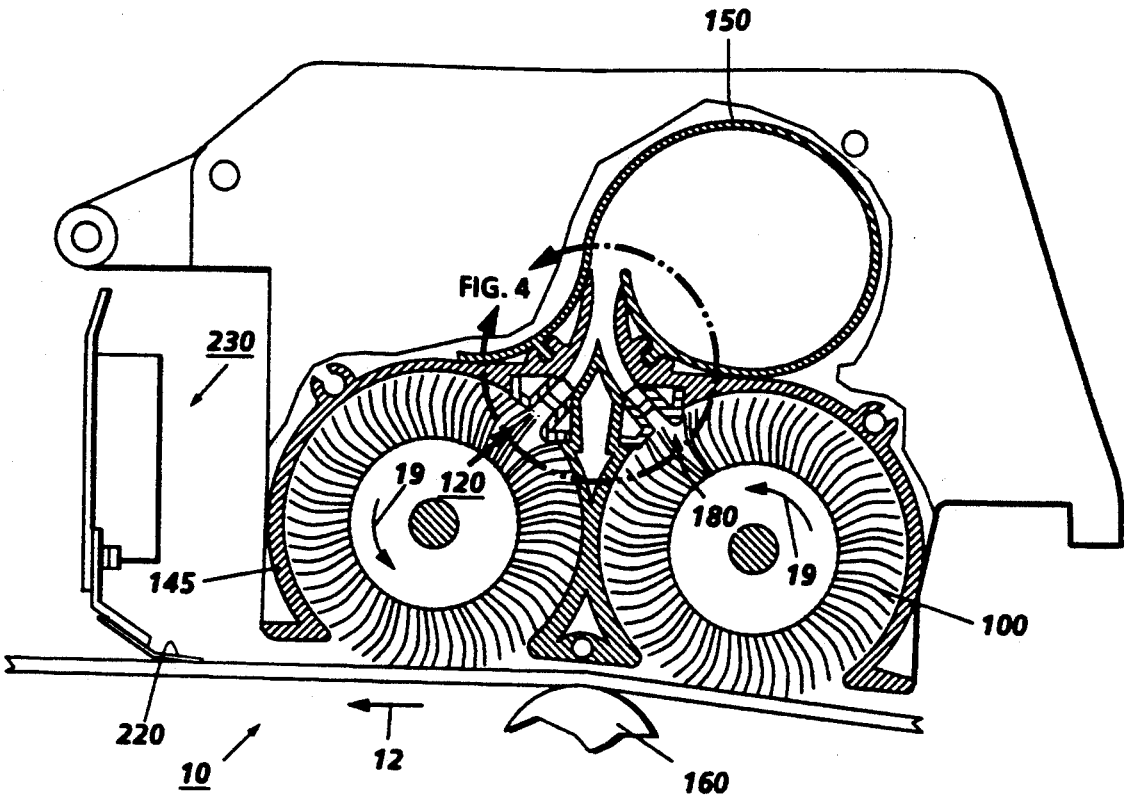
FIG. 3 is an elevational view of the dual brush cleaners with the flicker bar therein.

Reference is now made to FIG. 3, which is a frontal elevational view of the dual brush cleaners 100 with the flicker bars 120 inserted therein. The brushes 100 rotate in the direction indicated by arrow 19. The brush fibers frictionally contact the photoreceptor 10, moving in the direction of arrow 12 to clean the surface. A backer roll 160 provides support for the photoreceptor belt 10. The particles removed from the photoreceptor surface that adhere to the brush fibers are removed, from the brush fibers, when the fibers contact the protruding flicker bar edge 180. The flicker bar dislodges the toner and other debris particles held in the brush fibers as the brush is rotating. The air passage 190 (see FIG. 4) that is located after the flicker bar has a vacuum attached to the other end for removal of the dislodged particles away from the cleaner brushes 100. The air passage 190 carries the dislodged particles to an air manifold 150 which has a vacuum (not shown) on its opposite end creating the air flow that moves the particles away from the brush fibers.

With continued reference to FIG. 3, the brush cleaners 100 allowed by a spots blade assembly 230. The spots blade assembly 230 has a spots disturber blade 220 located upstream in the direction of movement 12 of the photoreceptor 10, to disturb residual particles not removed by the brushes 100. This spots disturber blade is similar to that used in the Xerox 5090 copier. The spots blade disturber 220 is normally in the doctoring mode to allow a build up of residual particles between the brush cleaner housing 145 and the spots blade 220. This build up of residual particles is removed by the air flow of the vacuum.

Figure 4:
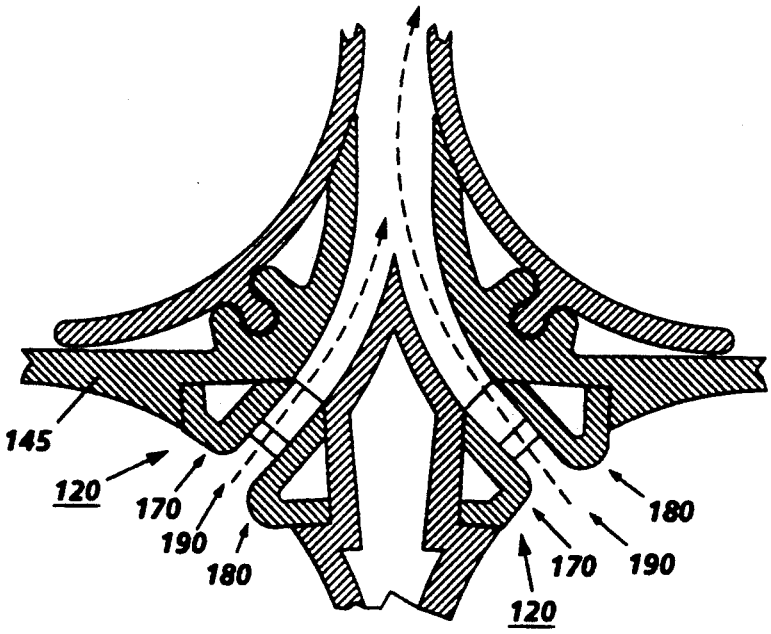
FIG. 4 is an exploded partial sectional elevational view of a portion of the flicker bar.

Reference is now made to FIG. 4, which shows an exploded, partial view of the area marked by circle 4 in FIG. 3. The flicker bars 120 are seated in the channel of the housing 145. The integral air channel of the flicker bar is uniform throughout the length of the flicker bar. The solitary construction of the flicker bar eliminates the nonuniformity due to assembly tolerances.

In recapitulation, it is evident that the flicker bar provides optimal access for service actions and features an integral air channel therein to guarantee proper air channel size. The solitary construction of the flicker bar eliminates variance in the air channel width due to assembly tolerances. The spacers in the top member of the flicker bar provide support in maintaining the uniform flicker bar width for the air channel. The variations of the flicking mechanism as to location and number for detoning purposes can be varied as needed for cleaning.

It is, therefore, apparent that there has been provided in accordance with the present invention, a flicker bar that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from a surface comprising:

a housing;

a rotatably mounted brush, at least partially enclosed in said housing, contacting the surface to remove particles therefrom; and a bar in contact with said brush for removing particles therefrom, said bar, defining a channel therein adapted to have air with particles flow therethrough, said bar being mounted movably into said housing.

2. An apparatus as recited in claim 1, further comprising means, coupled to said channel, for generating a flow of air therethrough.

3. An apparatus as recited in claim 2, wherein the channel of said bar is substantially uniform in width therealong, said bar being a unitary member.

4. An apparatus for removing particles from a surface comprising:

a housing;

a rotatably mounted brush, at least partially enclosed in said housing, contacting the surface to remove particles therefrom;

a bar in contact with said brush for removing particles therefrom, said bar, defining a substantially uniform width channel therein adapted to have air entrained with particles flowing therethrough, said bar, being a unitary member, comprising a first member, a second member substantially parallel to said first member, said first member and said second member each having an inner surface and an outer surface opposed from one another, with said inner surface of said first member and said inner surface of said second member, being opposed from one another, and a top member, substantially perpendicular to and interposed between said first member and said second member, connecting said first member to said second member defining the channel between said first and second member and said top member; and means coupled to the channel, for generating a flow of air through the channel.

5. An apparatus as recited in claim 4, wherein said top member defines a slot connected to the channel to allow air and particles to pass therethrough from said brush.

6. An apparatus as recited in claim 5, wherein said generating means is connected to the slot in said top member to enable air and particles from said brush to pass through the slot into said generating means.

7. An apparatus as recited in claim 6, wherein said bar is mounted slidably into said housing.

8. An apparatus as recited in claim 7, wherein said bar comprises a front end; and a back end, said front end including a handle enabling said bar to be inserted into and removed from said housing.

* * * * *